US008626518B2

(12) United States Patent
Lang et al.

(10) Patent No.: US 8,626,518 B2
(45) Date of Patent: Jan. 7, 2014

(54) MULTI-CHANNEL SIGNAL ENCODING AND DECODING METHOD, APPARATUS, AND SYSTEM

(75) Inventors: Yue Lang, München (DE); Wenhai Wu, Beijing (CN); Lei Miao, Beijing (CN); Chen Hu, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 13/530,819

(22) Filed: Jun. 22, 2012

(65) Prior Publication Data

US 2012/0265543 A1 Oct. 18, 2012

Related U.S. Application Data

(63) Continuation of application No. PCT/CN2010/079167, filed on Nov. 26, 2010.

(30) Foreign Application Priority Data

Feb. 11, 2010 (CN) ..... 2010 1 0113634

(51) Int. Cl.
*G10L 19/00* (2013.01)

(52) U.S. Cl.
USPC ..... 704/500

(58) Field of Classification Search
USPC ..... 704/200, 200.1, 500–504; 381/1, 10, 381/22–23
See application file for complete search history.

(56) References Cited

U.S. PATENT DOCUMENTS

| | | | | |
|---|---|---|---|---|
| 6,741,965 | B1 | 5/2004 | Shimoyoshi et al. | |
| 7,719,445 | B2 * | 5/2010 | Jung et al. | 341/60 |
| 2007/0242833 | A1 | 10/2007 | Herre et al. | |

(Continued)

FOREIGN PATENT DOCUMENTS

| | | | |
|---|---|---|---|
| CN | 1228236 | A | 9/1999 |
| CN | 1477872 | A | 2/2004 |

(Continued)

OTHER PUBLICATIONS

International search report for International application No. PCT/CN2010/079167, dated Mar. 3, 2011, total 5 pages.

(Continued)

*Primary Examiner* — Angela A Armstrong
(74) *Attorney, Agent, or Firm* — Conley Rose, P.C.; Grant Rodolph; Nicholas K. Beaulieu

(57) ABSTRACT

A multi-channel signal encoding method includes: determining a sum of channel level differences (CLDs) of a current frame of a multi-channel signal in a certain frequency band area; determining an average value of sums of channel level differences of at least two frames before the current frame in the certain frequency band area; according to the sum of channel level differences of the current frame of the multi-channel signal in the certain frequency band area, the average value of the sums of channel level differences of at least two frames before the current frame in the certain frequency band area, and a preset threshold, judging whether the channel level differences of the current frame are in a transient state or a non-transient state, and obtaining a judgment result; and according to the judgment result, performing quantization processing on the channel level differences of the current frame of the multi-channel signal.

18 Claims, 7 Drawing Sheets

(56) References Cited

U.S. PATENT DOCUMENTS

| | | | | |
|---|---|---|---|---|
| 2008/0167880 | A1 | 7/2008 | Seo et al. | |
| 2008/0252510 | A1 | 10/2008 | Jung et al. | |
| 2011/0224994 | A1 * | 9/2011 | Norvell et al. | 704/500 |

FOREIGN PATENT DOCUMENTS

| | | | |
|---|---|---|---|
| CN | 101223598 | A | 7/2008 |
| CN | 101421779 | A | 4/2009 |
| CN | 101427307 | A | 5/2009 |
| KR | 20100007750 | A | 1/2010 |
| WO | 2007011157 | A1 | 1/2007 |
| WO | 2007037621 | A1 | 4/2007 |

OTHER PUBLICATIONS

Foreign Communication From A Counterpart Application, PCT Application No. PCT/CN2010/079167, Written Opinion dated Mar. 3, 2011, 6 pages.

* cited by examiner

MULTI-CHANNEL SIGNAL ENCODING AND DECODING METHOD, APPARATUS, AND SYSTEM

CROSS-REFERENCE TO RELATED APPLICATIONS

This application is a continuation of International Application No. PCT/CN2010/079167, filed on Nov. 26, 2010, which claims priority to Chinese Patent Application No. 201010113634.X, filed on Feb. 11, 2010, both of which are hereby incorporated by reference in their entireties.

FIELD OF THE INVENTION

The present invention relates to an audio processing technology field, and in particular to a multi-channel signal encoding method, decoding method, encoding apparatus, decoding apparatus, and encoding and decoding system.

BACKGROUND OF THE INVENTION

As the people's living standards are increasingly improved, high-quality speakers are gradually spreading among ordinary families. A multi-channel speaker produces high-quality acoustic effects. The channel level difference (channel level difference, CLD) is an important parameter that reflects the sound field of multi-channel signals. This parameter indicates the energy relationship between two signals in a multi-channel signal within each frequency band. It is widely used in existing multi-channel encoding algorithms, such as strength multi-channel signal, parameter multi-channel signal, and Panning algorithms. The channel level difference uses a scalar quantizer for quantization processing. This scalar quantizer is a 31-dimensional vector codebook $CLD_s$. This vector codebook $CLD_s$=[−50, −45, −40, −35, −30, −25, −22, −19, −16, −13, −10, −8, −6, −4, −2, 0, 2, 4, 6, 8, 10, 13, 16, 19, 22, 25, 30, 35, 40, 45, 50]. The dimension of the codebook is five bits. Quantization processing is performed for the channel level difference according to the vector codebook $CLD_s$. Each element in the vector codebook $CLD_s$ indicates the quantization level for CLD.

During the implementation of the present invention, the inventor discovers the following disadvantages in the prior art:

The prior art uses a same method for quantization processing of channel level differences of all types, but does not quantizes the channel level differences according to the characteristics of the channel level differences, leading to poor flexibility in quantizing channel level differences of a multi-channel signal.

SUMMARY OF THE INVENTION

Embodiments of the present invention provide a multi-channel signal encoding method, decoding method, encoding apparatus, and decoding apparatus, which may improve flexibility in quantizing channel level differences of a multi-channel signal.

An embodiment of the present invention provides a multi-channel signal encoding method. The method includes:

determining a sum of channel level differences (CLDs) of a current frame of a multi-channel signal in a certain frequency band area;

determining an average value of sums of channel level differences of at least two frames before the current frame in the certain frequency band area;

according to the sum of channel level differences of the current frame of the multi-channel signal in the certain frequency band area, the average value of the sums of channel level differences of at least two frames before the current frame in the certain frequency band area, and a preset threshold, judging whether the channel level differences of the current frame are in a transient state or a non-transient state, and obtaining a judgment result; and according to the judgment result, performing quantization processing on the channel level differences of the current frame of the multi-channel signal.

An embodiment of the present invention provides a multi-channel signal decoding method. The method includes:

receiving encoding information from an encoding end, where the encoding information indicates whether channel level differences of a current frame of a multi-channel signal are in a transient state or a non-transient state;

if the encoding information indicates that the channel level differences of the current frame are in the transient state, using first quantization precision to de-quantize encoding data of the channel level differences of the current frame of the multi-channel signal; and if the encoding information indicates that the channel level differences of the current frame are in the non-transient state, using second quantization precision to de-quantize encoding data of the channel level differences of the current frame of the multi-channel signal; where, the first quantization precision is higher than the second quantization precision.

An embodiment of the present invention provides a multi-channel signal encoding apparatus. The apparatus includes:

a first determining unit, configured to determine a sum of channel level differences (CLDs) of a current frame of a multi-channel signal in a certain frequency band area;

a second determining unit, configured to determine an average value of sums of channel level differences (CLDs) of at least two frames before the current frame in the certain frequency band area;

a judging unit, configured to: according to the sum of channel level differences (CLDs) of the current frame of the multi-channel signal in the certain frequency band area, the average value of the sums of channel level differences (CLDs) of at least two frames before the current frame in the certain frequency band area, and a preset threshold, judge whether the channel level differences of the current frame are in a transient state or a non-transient state, and obtain a judgment result;

a quantizing unit, configured to: according to the judgment result, perform quantization processing on the channel level differences of the current frame of the multi-channel signal.

An embodiment of the present invention provides a multi-channel signal decoding apparatus. The apparatus includes:

a receiving unit, configured to receive encoding information from an encoding end, where the encoding information indicates whether CLDs of a current frame of a multi-channel signal are in a transient state or a non-transient state; and a de-quantizing unit, configured to: if the encoding information indicates that the channel level differences (CLDs) of the current frame are in the transient state, use first quantization precision to de-quantize encoding data of the channel level differences of the current frame of the multi-channel signal; and if the encoding information indicates that the channel level differences of the current frame are in the non-transient state, use second quantization precision to de-quantize encoding data of the channel level differences of the current frame of the multi-channel signal; where, the first quantization precision is higher than the second quantization precision.

An embodiment of the present invention provides a multi-channel signal encoding and decoding system. The system includes:

an encoding end, configured to: determine a sum of channel level differences (CLDs) of a current frame of a multi-channel signal in a certain frequency band area; determine an average value of sums of channel level differences (CLDs) of at least two frames before the current frame in the certain frequency band area; according to the sum of channel level differences of the current frame of the multi-channel signal in the certain frequency band area, the average value of the sums of channel level differences of at least two frames before the current frame in the certain frequency band area, and a preset threshold, judge whether the CLDs of the current frame are in a transient state or a non-transient state, and obtain a judgment result; according to the judgment result, perform quantization processing on the channel level differences of the current frame of the multi-channel signal to obtain encoding data of channel level differences of the current frame; and send the encoding data of channel level differences of the current frame and the judgment result to a decoding end; and a decoding end, configured to receive the encoding data of channel level differences of the current frame and the judgment result sent from the encoding end, and de-quantize the encoding data of channel level differences of the current frame according to the judgment result.

Embodiments of the present invention provide a multi-channel signal encoding method, decoding method, encoding device, and decoding device to judge on the encoding end whether the CLDs of the current frame are in a transient state or a non-transient state, and perform relevant quantization processing on the channel level differences of the current frame of the multi-channel signal, improving flexibility in quantizing channel level differences of multi-channel signal.

BRIEF DESCRIPTION OF THE DRAWINGS

To make the technical solution of the present invention clearer, the accompanying drawings for illustrating the embodiments of the present invention or the prior art are described below. Apparently, the accompanying drawings are for the exemplary purpose only, and person having ordinary skill in the art may derive other drawings from such accompanying drawings without any creative effort.

DETAILED DESCRIPTION OF THE EMBODIMENTS

The technical solution under the present invention is described below with reference to the accompanying drawings. Evidently, the embodiments described below are for the exemplary purpose only, without covering all embodiments of the present invention. Those skilled in the art may derive other embodiments from the embodiments given herein without making any creative effort, and all such embodiments are covered in the protection scope of the present invention.

The channel level difference (Channel Level Difference, CLD) is a parameter that reflects the sound field of multi-channel signals. The parameter reflects the energy relationship between two signals in a multi-channel signal within each frequency band. The logarithmic energy ratio of the CLD in each frequency band is as follows:

$$CLD[b] = 10\log_{10}\frac{\sum_{k=k_b}^{k_{b+1}-1} X_1[k]X_1^*[k]}{\sum_{k=k_b}^{k_{b+1}-1} X_2[k]X_2^*[k]},$$

where, k indicates a frequency index, $X_1[k]$ indicates the kth spectral coefficient of the first audio channel, $X_1^*[k]$ indicates the conjugation of $X_1[k]$, $X_2[k]$ indicates the kth spectral coefficient of the second audio channel, $X_2^*[k]$ indicates the conjugation of $X_2[k]$, b indicates a frequency band index, and $K_b$ indicates the start frequency band index of the bth frequency band.

The multi-channel signal in this embodiment include a multi-channel signal such as stereo, 5.1 audio channels, 7.1 audio channels, and 10.2 audio channels.

In this embodiment, the transient state may be that: the sound field of multi-channel signals switches from one state to another state, which takes short time, and is in an unstable state.

Embodiment 1

Figure 1:
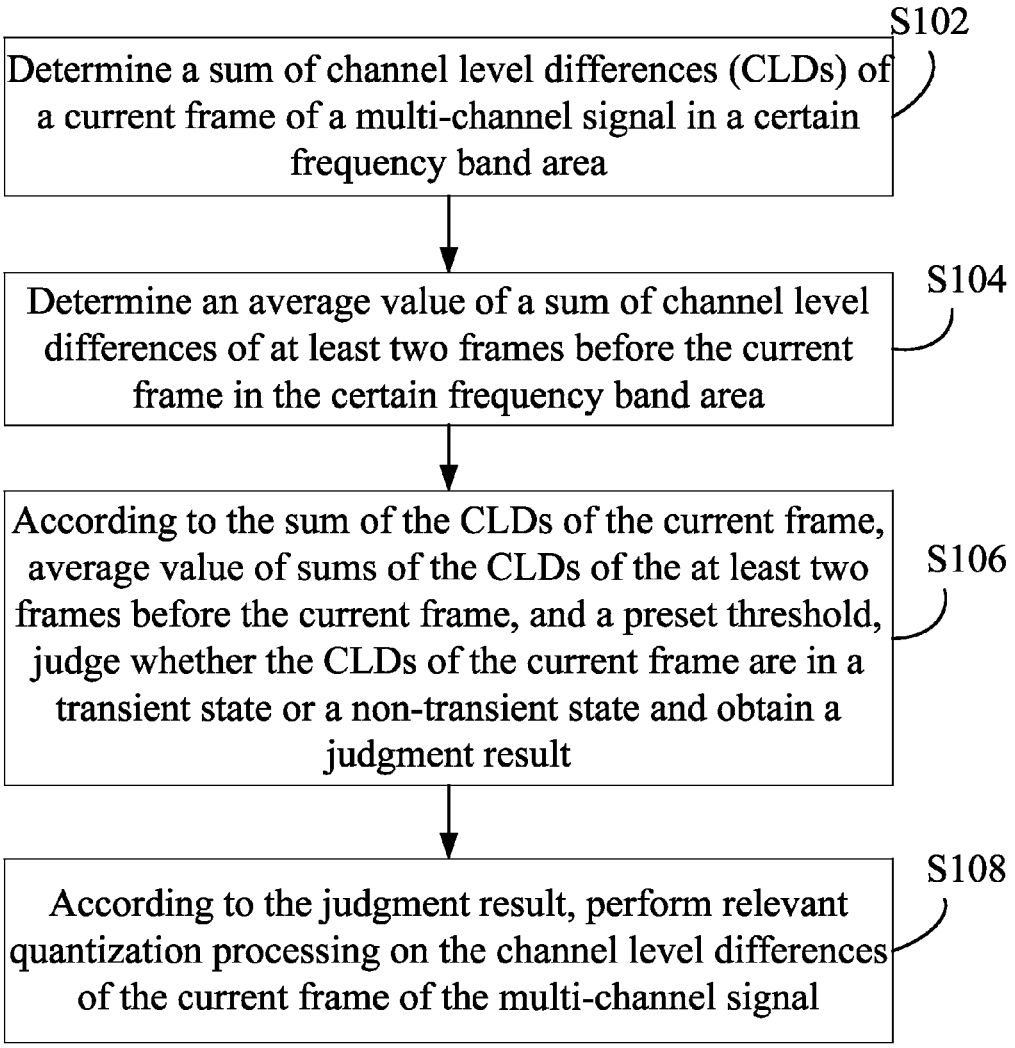
FIG. 1 is a flowchart of a multi-channel signal encoding method provided in an embodiment of the present invention.

As shown in FIG. 1, this embodiment of the present invention provides a multi-channel signal encoding method, including steps 102-108, where:

Step 102: Determine a sum of channel level differences (CLDs) of a current frame of a multi-channel signal in a certain frequency band area.

In this embodiment, the certain frequency band area may be an entire frequency band, or a preset partial frequency band area. For example, an entire frequency band is divided into two frequency bands: a high frequency band and a low frequency band. The sum of CLDs of the current frame of the multi-channel signal in the high frequency band area is calculated.

Step 104: Determine an average value of sums of channel level differences (CLDs) of at least two frames before the current frame in the certain frequency band area.

This step may be as follows: calculating an average value of CLDs of N frames that include the current frame and N−1 frames before the current frame according to the sum of CLDs of the current frame in the certain frequency band area and the sum of CLDs of the N−1 frames before the current frame in the certain frequency band area. The N−1 frames may be consecutive or non-consecutive.

In this embodiment, the at least two frames before the current frame may be at least two frames that include the current frame, or at least two frames that do not include the current frame.

Step 106: According to the sum of CLDs of the current frame, the average value of sums of CLDs of at least two frames before the current frame, and a preset threshold (non-negative number), judge whether the CLDs of the current frame are in a transient state or a non-transient state and obtain a judgment result. This step may be as follows:

obtaining an absolute value of a difference between the sum of CLDs of the current frame and the average value of the CLDs of the at least two frames before the current frame;

comparing the absolute value of the difference with the preset threshold;

if the absolute value of the difference is greater than the threshold, determining that the CLDs of the current frame are in the transient state; and if the absolute value of the difference is smaller than the threshold, determining that the CLDs of the current frame are in the non-transient state.

The threshold in this embodiment may be obtained according to experience values, or by collecting statistics. For example, statistics about all absolute values of differences in historic data are collected, and a minimum value corresponding to the case in which the CLDs are in the transient state is preset as the threshold.

Step 108: According to the judgment result obtained in step 106, perform quantization processing on the channel level differences of the current frame of the multi-channel signal.

This step may be as follows:

when the CLDs of the current frame are in the transient state, using first quantization precision to quantize the channel level differences of the current frame of the multi-channel signal; and when the CLDs of the current frame are in the non-transient state, using second quantization precision to quantize the channel level differences of the current frame of the multi-channel signal; where, the first quantization precision may be higher than the second quantization precision. For example, the first quantization precision is 5, and the second quantization precision is 1.

The channel level differences of the current frame of the multi-channel signal that are quantized in this step may be channel level differences in an entire frequency band or a certain frequency band area.

Alternatively, this embodiment may further include:

Step 110: Send encoding data of the channel level differences of the current frame obtained through quantization in step 108 to a decoding end to decode.

Alternatively, this embodiment may further include:

Step 112: Send the judgment result obtained in step 106 to the decoding end, so that the decoding end decodes the encoding data of the channel level differences of the current frame according to the judgment result. Decoding, by the decoding end, the encoding data of the channel level differences of the current frame according to the judgment result includes:

if the judgment result indicates that the CLDs of the current frame are in the transient state, using, by the decoding end, the first quantization precision to de-quantize the encoding data of the channel level differences of the current frame of the multi-channel signal; and if the judgment result indicates that the CLDs of the current frame are in the non-transient state, using, by the decoding end, the second quantization precision to de-quantize the encoding data of the channel level differences of the current frame of the multi-channel signal; where, the first quantization precision is higher than the second quantization precision.

Alternatively, this embodiment may further include:

Step 114: If the judgment result obtained in step 106 indicates that the CLDs of the current frame are in the transient state, send the first quantization precision used in step 108 to the decoding end, so that the decoding end de-quantizes the encoding data of the channel level differences of the current frame of the multi-channel signal according to the first quantization precision.

Step 116: If the judgment result obtained in step 106 indicates that the CLDs of the current frame are in the non-transient state, send the second quantization precision used in step 108 to the decoding end, so that the decoding end de-quantizes the encoding data of the channel level differences of the current frame of the multi-channel signal according to the second quantization precision.

The sequence of the preceding steps in this embodiment may be adjusted according to actual needs. The preceding steps may be executed by the decoding end.

Through the embodiment of the present invention, by judging whether the CLDs of the current frame are in the transient or non-transient state and performing quantization processing on the channel level differences of the current frame of the multi-channel signal according to the judgment result, flexibility in quantizing channel level differences of a multi-channel signal may be improved; by using high quantization precision to quantize the channel level differences of the current frame of the multi-channel signal in the transient state, the re-establishment quality of the channel level differences of the current frame of the multi-channel signal may be maintained or improved; by using low quantization precision to quantize the channel level differences of the current frame of the multi-channel signal in the non-transient state, a bit rate may be reduced, and the re-establishment quality of the channel level differences of the current frame of the multi-channel signal may be maintained.

Embodiment 2

Figure 2:
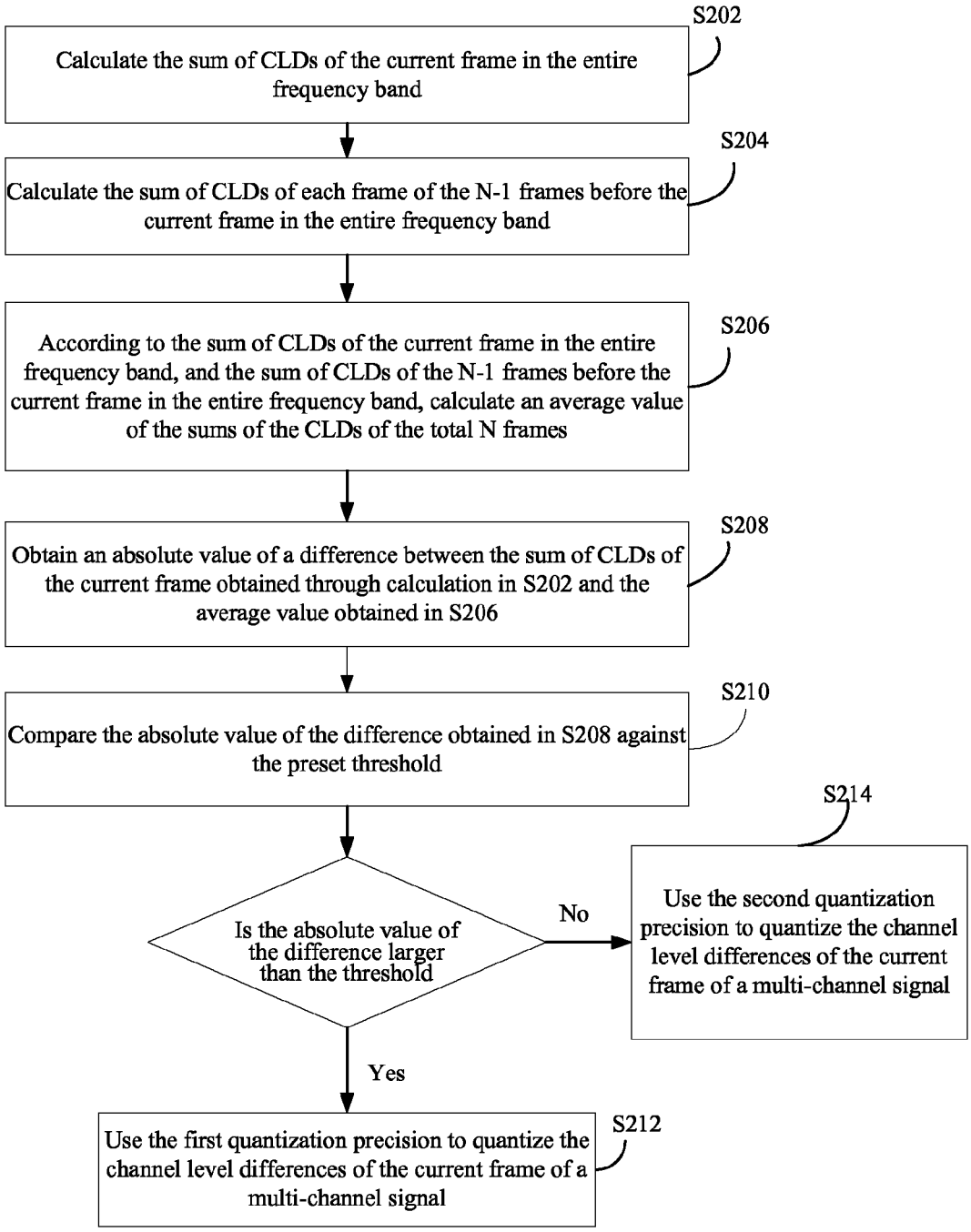
FIG. 2 is a flowchart of another multi-channel signal encoding method provided in an embodiment of the present invention.

As shown in FIG. 2, this embodiment further describes the method based on Embodiment 1. This embodiment includes steps 202-210, where:

Step 202: Calculate the sum of CLDs of the current frame of the multi-channel signal in the entire frequency band, that is:

$$CLD^{(c)}_\text{sum} = \sum_{b=1}^{M} CLD^{(c)}[b];$$

where, c indicates the index number of the current frame, b indicates a frequency band index, M indicates the number of frequency bands in the entire frequency band, $CLD^{(c)}$ [b] indicates the channel level difference of the current frame in the bth frequency band, and $CLD^{(c)}$_sum indicates the sum of CLDs of the current frame in the entire frequency band.

Step 204: Calculate the sum of CLDs of each frame of N−1 frames before the current frame in the entire frequency band, where the N−1 frames may be consecutive or non-consecutive. To facilitate description, the following takes consecutive N−1 frames as an example. That is:

$$CLD^{(i)}_\text{sum} = \sum_{b=1}^{M} CLD^{(i)}[b];$$

where, i=c−N+1, c−2, c−1; i indicates the index number of the current frame, b indicates a frequency band index, M indicates the number of frequency bands in the entire frequency band, $CLD^{(i)}$ [b] indicates the channel level difference of the ith frame in the bth frequency band, and $CLD^{(i)}$_sum indicates the sum of CLDs of the ith frame in the entire frequency band.

Step 206: According to the sum of CLDs of the current frame of the multi-channel signal in the entire frequency band, and the sum of CLDs of the N−1 frames before the current frame in the entire frequency band, calculate an average value of the sums of the CLDs of the total N frames, that is:

$$CLD^{(Ave_N)}_\text{sum} = \left(\sum_{i=c-N+1}^{c} CLD^{(i)}_\text{sum} + CLD^{(c)}_\text{sum}\right) \Big/ N;$$

where, $CLD^{(Ave_N)}$_sum indicates the average value of the sums of the CLDs of the total N frames in the entire frequency band.

In this step, when the average value is calculated, only the average value of the sums of CLDs of the N−1 frames before the current frame in the entire frequency band may be calculated, without considering the sum of CLDs of the current frame. The calculation method may be flexibly adjusted according to actual situations.

Step 208: Obtain an absolute value of a difference between the sum of CLDs of the current frame obtained through calculation in step 202 and the average value obtained in step 206, that is:

sub=abs($CLD^{(c)}$_sum−$CLD^{(Ave_N)}$_sum), where sub indicates the absolute value of the difference, and abs(*) indicates a function for obtaining the absolute value.

Step 210: Compare the absolute value of the difference obtained in step 208 with the preset threshold Thr (non-negative number); if the absolute value of the difference is greater than the threshold, that is, sub>Thr, determine that the CLDs of the current frame are in the transient state, and go to step 212; if the absolute value of the difference is smaller than the threshold, that is, sub<Thr, determine that the CLDs of the current frame are in the non-transient state, and go to step 214; if the absolute value of the difference is equal to the threshold, that is, sub=Thr, determine that the CLDs of the current frame are in the transient or non-transient state.

Step 212: Use the first quantization precision to quantize the channel level differences of the current frame of the multi-channel signal.

Step 214: Use the second quantization precision to quantize the channel level differences of the current frame of the multi-channel signal.

The channel level differences of the current frame of the multi-channel signal that are quantized in this embodiment may be channel level differences in an entire frequency band or a certain frequency band area.

The first quantization precision is higher than the second quantization precision. For example, the first quantization precision is 5, and the second quantization precision is 1.

The sequence of the preceding steps in this embodiment may be adjusted according to actual needs. The preceding steps may be executed by the decoding end.

Through the embodiment of the present invention, by judging whether the CLDs of the current frame are in the transient or non-transient state, and performing quantization processing on the channel level differences of the current frame of the multi-channel signal according to the judgment result, flexibility in quantizing channel level differences of a multi-channel signal may be improved; by using high quantization precision to quantize the channel level differences of the current frame of the multi-channel signal in the transient state, the re-establishment quality of the channel level differences of the current frame of the multi-channel signal may be maintained or improved; by using low quantization precision to quantize the channel level differences of the current frame of the multi-channel signal in the non-transient state, a bit rate may be reduced, and the re-establishment quality of the channel level differences of the current frame of the multi-channel signal may be maintained.

Embodiment 3

This embodiment is based on Embodiment 2. The difference lies in that, in this embodiment, the entire frequency band is divided into two frequency bands: a high frequency band and a low frequency band, and the high frequency band area may be selected to calculate the sum of CLDs. Certainly, the low frequency band area may be also selected to calculate the sum of CLDs.

Figure 3:
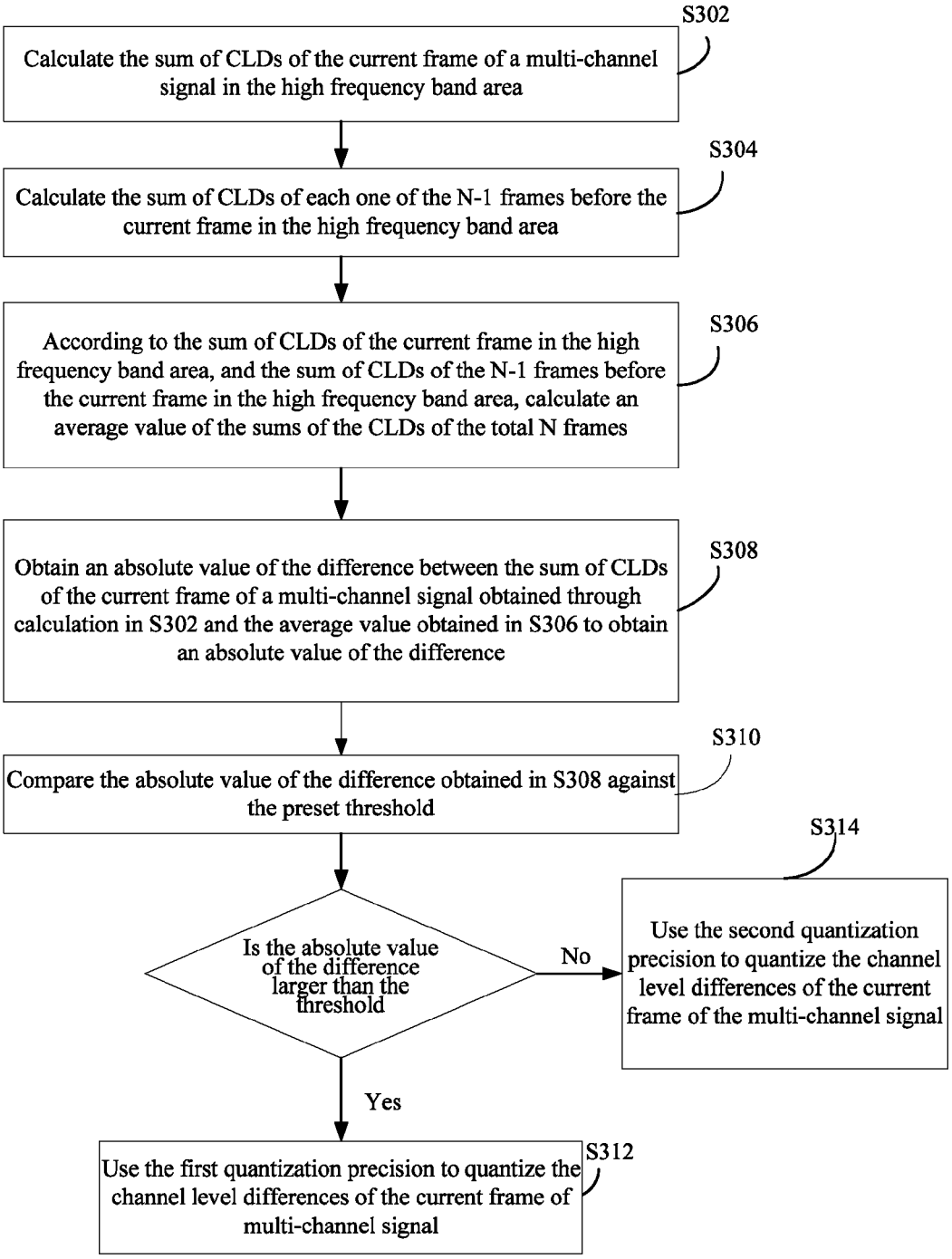
FIG. 3 is a flowchart of another multi-channel signal encoding method provided in an embodiment of the present invention.

As shown in FIG. 3, this embodiment includes steps 302-310, where:

Step 302: Calculate the sum of CLDs of the current frame of the multi-channel signal in the high frequency band area, that is:

$$CLD^{(c)}_\text{sum_h} = \sum_{b=K}^{M} CLD^{(c)}[b];$$

where, c indicates the index number of the current frame, b indicates a frequency band index, M indicates the number of frequency bands in the entire frequency band, K indicates the lower cut-off band of the high frequency band area (K<M), $CLD^{(c)}$ [b] indicates the channel level difference of the current frame in the bth frequency band, and $CLD^{(i)}$_sum indicates the sum of CLDs of the current frame in the high frequency band area.

Step 304: Calculate the sum of CLDs of each frame of N−1 frames before the current frame in the high frequency band area, where the N−1 frames may be consecutive or non-consecutive. To facilitate description, the following takes consecutive N−1 frames as an example. That is:

$$CLD^{(i)}_\text{sum_h} = \sum_{b=K}^{M} CLD^{(i)}[b];$$

where, i=c−N+1, . . . , c−2, c−1; i indicates the index number of the current frame, b indicates a frequency band index, M indicates the number of frequency bands in the entire frequency band, K indicates the lower cut-off band of the high frequency band area (K<M), $CLD^{(i)}$ [b] indicates the channel level difference of the ith frame in the bth frequency band, and $CLD^{(c)}$_sum_h indicates the sum of CLDs of the ith frame in the high frequency band area.

Step 306: According to the sum of CLDs of the current frame in the high frequency band area, and the sum of CLDs of the N−1 frames before the current frame in the high frequency band area, calculate an average value of the sums of the CLDs of the total N frames in the high frequency band area, that is:

$$CLD^{(Ave_N)}_\text{sum_h} = \left(\sum_{i=c-N+1}^{c} CLD^{(i)}_\text{sum_h} + CLD^{(c)}_\text{sum_h}\right) \Big/ N;$$

where, $CLD^{(Ave_N)}$_sum_h indicates the average value of the sums of the CLDs of the total N frames in the high frequency band area.

In this step, when the average value is calculated, only the average value of the sums of CLDs of the N−1 frames before the current frame in the high frequency band area may be calculated, without considering the sum of CLDs of the current frame. The calculation method may be flexibly adjusted according to actual situations.

Step 308: Obtain an absolute value of the difference between the sum of CLDs of the current frame of the multi-channel signal obtained through calculation in step 302 and the average value obtained in step 306;

sub=abs($CLD^{(c)}$_sum_h−$CLD^{(Ave_N)}$_sum), where sub indicates the absolute value of the difference, and abs(*) indicates the function for obtaining the absolute value.

Step 310: Compare the absolute value of the difference obtained in step 308 with the preset threshold Thr (non-negative number); if the absolute value of the difference is greater than the threshold, that is, sub>Thr, determine that the CLDs of the current frame are in the transient state, and go to step 312; if the absolute value of the difference is smaller than the threshold, that is, sub<Thr, determine that the CLDs of the current frame are in the non-transient state, and go to step 314; if the absolute value of the difference is equal to the threshold, that is, sub=Thr, determine that the CLDs of the current frame are in the transient or non-transient state.

Step 312: Use the first quantization precision to quantize the channel level differences of the current frame of the multi-channel signal.

Step 314: Use the second quantization precision to quantize the channel level differences of the current frame of the multi-channel signal;

The channel level differences of the current frame of the multi-channel signal that are quantized in this embodiment may be channel level differences in an entire frequency band or a certain frequency band area.

The first quantization precision is higher than the second quantization precision. For example, the first quantization precision is 5, and the second quantization precision is 1.

The sequence of the preceding steps in this embodiment may be adjusted according to actual needs. The preceding steps may be executed by the decoding end.

Through the embodiment of the present invention, by judging whether the CLDs of the current frame are in the transient or non-transient state, and performing quantization processing on the channel level differences of the current frame of the multi-channel signal according to the judgment result, flexibility in quantizing channel level differences of multi-channel signal may be improved; by using high quantization precision to quantize the channel level differences of the multi-channel signal in the transient state, the re-establishment quality of the channel level differences of the current frame of the multi-channel signal may be maintained or improved; by using low quantization precision to quantize the channel level differences of the multi-channel signal in the non-transient state, a bit rate may be reduced, and the re-establishment quality of the channel level differences of the current frame of the multi-channel signal may be maintained.

Embodiment 4

This embodiment is based on Embodiment 2 and Embodiment 3. Embodiment 2 is executed to obtain a judgment result D1 when the entire frequency band is selected as the frequency band area for calculating the CLDs; Embodiment 3 is executed to obtain a judgment result D2 when the high frequency band area is selected as the frequency band area for calculating the CLDs. By considering D1 and D2, a final judgment result D3 is obtained.

For example, implement OR on D1 and D2 to obtain D3. Specifically, the following method may be used: if the judgment result indicates the transient state, the value of the judgment result is 1; if the judgment result indicates the non-transient state, the value of the judgment result is 0. Then, when D1 indicates the transient state, that is, D1=1: if D2 indicates the non-transient state, that is, D2=0, D3=D1 or D2=1 or 0=1; if D2 indicates the transient state, that is, D2=1, D3=D1 or D2=1 or 1=1. Then, when D1 indicates the non-transient state, that is, D1=0: if D2 indicates the non-transient state, that is, D2=0, D3=D1 or D2=0 or 0=0; if D2 indicates the transient state, that is, D2=1, D3=D1 or D2=0 or 1=1. That is, as long as one judgment result indicates that the CLDs are in the transient state, the final result is the transient state. Certainly, the value of the transient state may also be 0.

The sequence of the preceding steps in this embodiment may be adjusted according to actual needs. The preceding steps may be executed by the decoding end. The channel level differences of the current frame of the multi-channel signal that are quantized in this embodiment may be channel level differences in an entire frequency band or a certain frequency band area.

Through the embodiment of the present invention, by judging whether the CLDs of the current frame are in the transient or non-transient state, and performing quantization processing on the channel level differences of the current frame of the multi-channel signal according to the judgment result, flexibility in quantizing channel level differences of multi-channel signal may be improved; by using high quantization precision to quantize the CLDs of the multi-channel signal in the transient state, the re-establishment quality of the channel level differences of the current frame of the multi-channel signal may be maintained or improved; by using low quantization precision to quantize the channel level differences of the current frame in the non-transient state, a bit rate may be reduced, and the re-establishment quality of the channel level differences of the current frame may be maintained.

Embodiment 5

Figure 4:
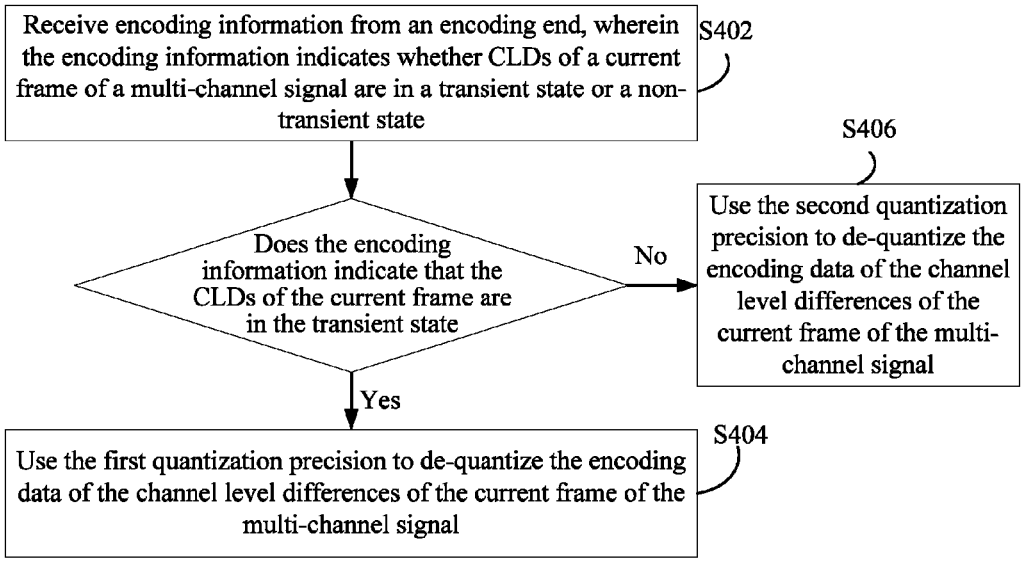
FIG. 4 is a flowchart of a multi-channel signal decoding method provided in an embodiment of the present invention.

As shown in FIG. 4, this embodiment of the present invention provides a multi-channel signal decoding method, including steps 402-408, where:

Step 402: Receive encoding information from an encoding end, where the encoding information indicates whether the CLDs of a current frame of a multi-channel signal are in a transient or non-transient state; if the encoding information indicates that the CLDs of the current frame of the multi-channel signal are in the transient state, go to step 404; if the encoding information indicates that the CLDs of the current frame of the multi-channel signal are in the non-transient state, go to step 406.

Step 404: Use first quantization precision to de-quantize encoding data of the channel level differences of the current frame of the multi-channel signal.

Step 406: Use second quantization precision to de-quantize the encoding data of the channel level differences of the current frame of the multi-channel signal.

The first quantization precision is higher than the second quantization precision. For example, the first quantization precision is 5, and the second quantization precision is 1.

In addition, the encoding information from the encoding end may indicate the quantization precision of the current frame. A decoding end de-quantizes the encoding data of the channel level differences of the current frame according to the quantization precision information.

This embodiment may further include:

Step 400: Receive the encoding data of the channel level differences of the current frame of the multi-channel signal from the encoding end.

The sequence of the preceding steps in this embodiment may be adjusted according to actual needs. The preceding steps may be executed by the decoding end.

Through the embodiment of the present invention, by de-quantizing the encoding data of the channel level differences of the current frame of the multi-channel signal according to the encoding information, flexibility in de-quantizing channel level differences of a multi-channel signal may be improved; by using high quantization precision to de-quantize the encoding data of the channel level differences in the transient state, the re-establishment quality of the channel level differences of the current frame of the multi-channel signal may be maintained or improved; by using low quantization precision to de-quantize the encoding data of the channel level differences in the non-transient state, a bit rate may be reduced, and the re-establishment quality of the channel level differences of the current frame may be maintained.

Embodiment 6

Figure 5:
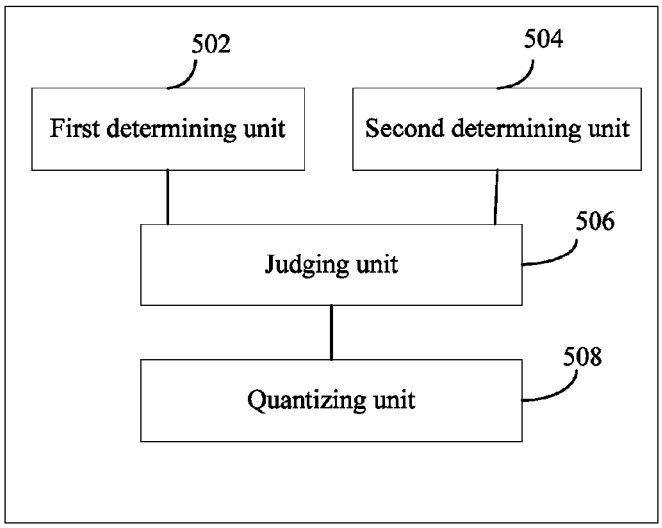
FIG. 5 is a structural diagram of a multi-channel signal encoding apparatus provided in an embodiment of the present invention.

As shown in FIG. 5, an embodiment of the present invention provides a multi-channel signal encoding apparatus. The apparatus includes:

a first determining unit 502, configured to determine a sum of channel level differences (CLDs) of a current frame of a multi-channel signal in a certain frequency band area;

a second determining unit 504, configured to determine an average value of sums of channel level differences (CLDs) of at least two frames before the current frame in the certain frequency band area;

a judging unit 506, configured to: according to the sum of the CLDs of the current frame determined by the first determining unit 502, the average value of the sums of the CLDs of the at least two frames before the current frame that is determined by the second determining unit 504, and a preset threshold, judge whether the CLDs of the current frame are in a transient state or a non-transient state, and obtain a judgment result; and a quantizing unit 508, configured to: according to the judgment result obtained by the judging unit 506, perform quantization processing on the channel level differences of the current frame of the multi-channel signal.

The channel level differences of the current frame of the multi-channel signal that are quantized in this embodiment may be channel level differences in an entire frequency band or a certain frequency band area.

In this embodiment, the certain frequency band area may be an entire frequency band, or a preset partial frequency band area. For example, an entire frequency band is divided into two frequency bands: a high frequency band and a low frequency band. The sum of the CLDs of the current frame of the multi-channel signal in the high frequency band area is calculated. In this embodiment, the at least two frames before the current frame may be at least two frames that include the current frame, or at least two frames that do not include the current frame.

Figure 6:
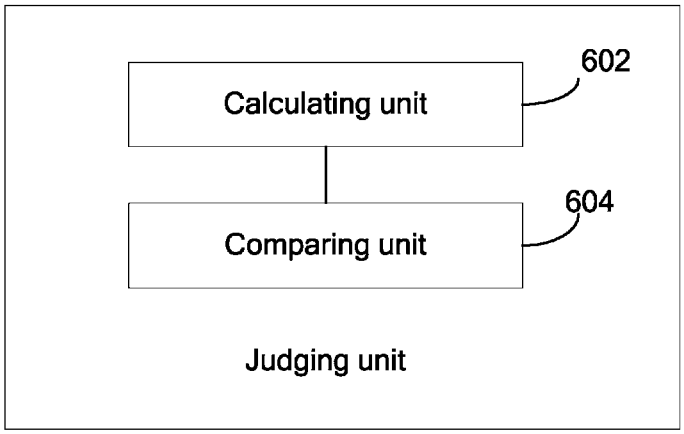
FIG. 6 is a structural diagram of a judging unit in a multi-channel signal encoding apparatus provided in an embodiment of the present invention.

As shown in FIG. 6, further, the judging unit 506 may include:

a calculating unit 602, configured to obtain an absolute value of the difference between the sum of the CLDs of the current frame of the multi-channel signal that is determined by the first determining unit 502 and the average value determined by the second determining unit 504; and a comparing unit 604, configured to compare the absolute value of the difference obtained by the calculating unit 602 with the preset threshold; if the absolute value of the difference is greater than the threshold, determine that the CLDs of the current frame are in the transient state; and if the absolute value of the difference is smaller than the threshold, determine that the CLDs of the current frame are in the non-transient state.

Figure 7:
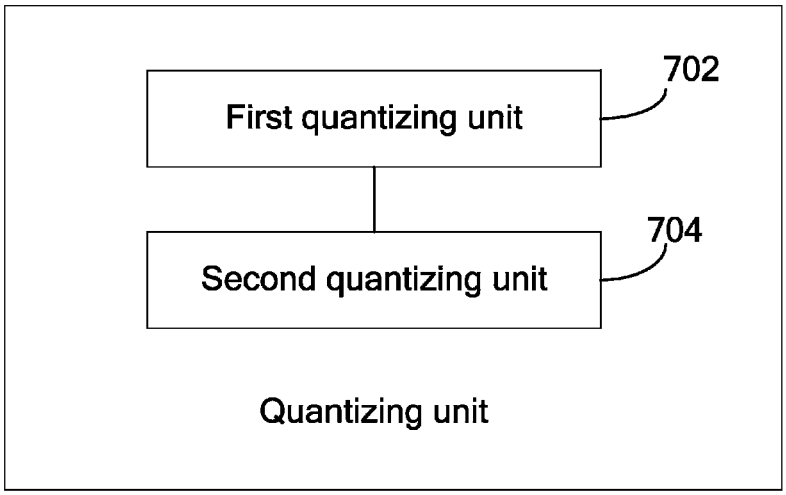
FIG. 7 is a structural diagram of a quantizing unit in a multi-channel signal encoding apparatus provided in an embodiment of the present invention.

As shown in FIG. 7, further, the quantizing unit 508 may include:

a first quantizing unit 702, configured to use first quantization precision to quantize the channel level differences of the current frame of the multi-channel signal when the judging unit 506 determines that the CLDs of the current frame are in the transient state; and a second quantizing unit 704, configured to use second quantization precision to quantize the channel level differences of the current frame of the multi-channel signal when the judging unit 506 determines that the CLDs of the current frame are in the non-transient state; where, the first quantization precision is higher than the second quantization precision. For example, the first quantization precision is 5, and the second quantization precision is 1.

Figure 8:
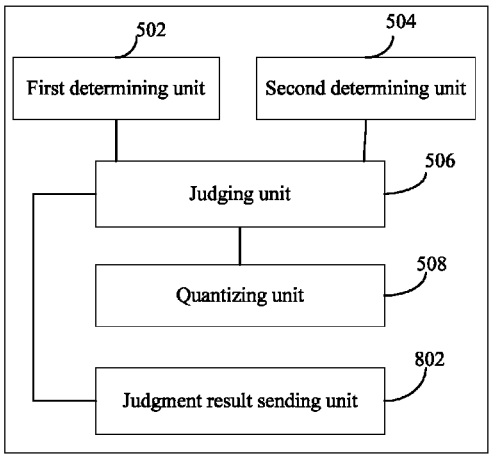
FIG. 8 is a structural diagram of another multi-channel signal encoding apparatus provided in an embodiment of the present invention.

As shown in FIG. 8, further, the multi-channel signal encoding apparatus provided in the embodiment of the present invention further includes:

a judgment result sending unit 802, configured to send the judgment result obtained by the judging unit 506 to a decoding end, so that the decoding end decodes encoding data of the channel level differences of the current frame according to the judgment result.

Figure 9:
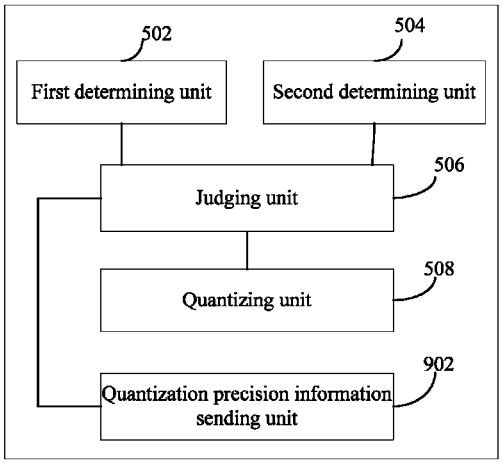
FIG. 9 is a structural diagram of another multi-channel signal encoding apparatus provided in an embodiment of the present invention.

As shown in FIG. 9, further, the multi-channel signal encoding apparatus provided in the embodiment of the present invention further includes:

a quantization precision information sending unit 902, configured to: when the judging unit 506 determines that the CLDs of the current frame are in the transient state, send first quantization precision to the decoding end, so that the decoding end de-quantizes the encoding data of the channel level differences of the current frame of the multi-channel signal according to the first quantization precision; and when the judging unit 506 determines that the CLDs of the current frame are in the non-transient state, send the second quantization precision to the decoding end, so that the decoding end de-quantizes the encoding data of the channel level differences of the current frame of the multi-channel signal according to the second quantization precision.

The multi-channel signal encoding apparatus in this embodiment may further include: an encoding data sending unit, configured to send the encoding data of the channel level differences of the current frame of the multi-channel signal quantized by the quantizing unit 508 to the decoding end.

Other details about the multi-channel signal encoding apparatus in this embodiment are similar to those about multi-channel signal encoding methods in Embodiment 1 to Embodiment 4.

All the units in this embodiment may be integrated or separately deployed. The preceding unit may be combined into one unit, or further divided into a plurality of sub units. The encoding apparatus in this embodiment may be integrated in a circuit or chip, including CPU, digital signal processing (Digital Signal Processing, DSP), or communication chip; or may be a mobile phone, an audio processing device, a computer, or a server.

Through the embodiment of the present invention, by judging whether the CLDs of the current frame are in the transient or non-transient state, and performing quantization processing on the channel level differences of the current frame of the multi-channel signal according to the judgment result, flexibility in quantizing channel level differences of a multi-channel signal may be improved; by using high quantization precision to quantize the channel level differences of the current frame of the multi-channel signal in the transient state, the re-establishment quality of the channel level differences of the current frame of the multi-channel signal may be maintained or improved; by using low quantization precision to quantize the channel level differences of the current frame in the non-transient state, a bit rate may be reduced, and the re-establishment quality of the channel level differences of the current frame may be maintained.

Embodiment 7

Figure 10:
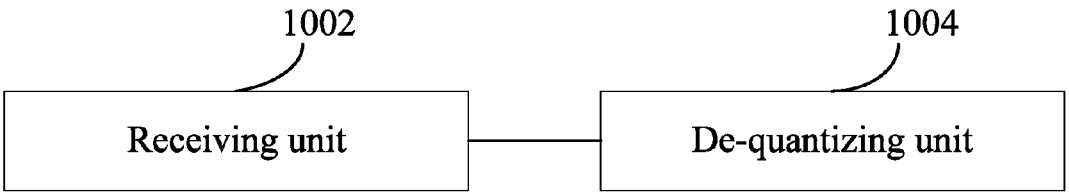
FIG. 10 is a structural diagram of a multi-channel signal decoding apparatus provided in an embodiment of the present invention.

As shown in FIG. 10, an embodiment of the present invention provides a multi-channel signal decoding apparatus. The apparatus includes:

a receiving unit 1002, configured to receive encoding information from an encoding end, where the encoding information indicates whether CLDs of a current frame are in a transient state or a non-transient state; and a de-quantizing unit 1004, configured to: when the encoding information indicates that the CLDs of the current frame are in the transient state, use first quantization precision to de-quantize encoding data of the channel level differences of the current frame of a multi-channel signal; and when the encoding information indicates that the CLDs of the current frame are in the non-transient state, use second quantization precision to de-quantize the encoding data of the channel level differences of the current frame of the multi-channel signal; where, the first quantization precision is higher than the second quantization precision. For example, the first quantization precision is 5, and the second quantization precision is 1.

In addition, the receiving unit 1002 may be configured to receive information that indicates quantization precision of the current frame from the encoding end, and the de-quantizing unit 1004 may be configured to de-quantize the encoding data of the channel level differences of the current frame according to the information. The receiving unit 1002 may also be configured to receive the encoding data of the channel level differences of the current frame from the encoding end. Other details about the multi-channel signal decoding apparatus in this embodiment are similar to those in the fifth embodiment.

Through the embodiment of the present invention, by de-quantizing the encoding data of the channel level differences of the current frame of the multi-channel signal according to the encoding information, flexibility in de-quantizing channel level differences of a multi-channel signal may be improved; by using high quantization precision to de-quantize the encoding data of the channel level differences in the transient state, the re-establishment quality of the channel level differences of the current frame of the multi-channel signal may be maintained or improved; by using low quantization precision to de-quantize the encoding data of the channel level differences in the non-transient state, a bit rate may be reduced, and the re-establishment quality of the channel level differences of the current frame may be maintained.

All the units in this embodiment may be integrated or separately deployed. The preceding unit may be combined into one unit, or further divided into a plurality of sub units. The encoding apparatus in this embodiment may be integrated in a circuit or chip, including CPU, digital signal processing (Digital Signal Processing, DSP), or communication chip; or may be a mobile phone, audio processing device, computer, or server.

Embodiment 8

Figure 11:
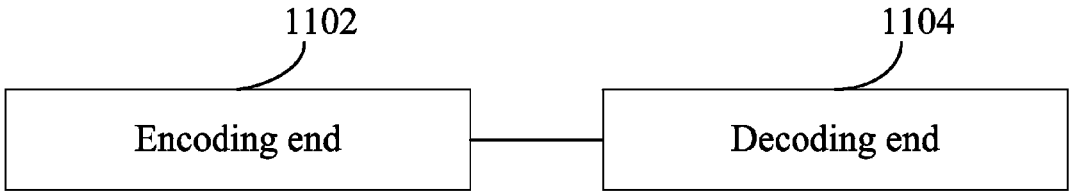
FIG. 11 is a structural diagram of a multi-channel signal encoding and decoding system provided in an embodiment of the present invention.

As shown in FIG. 11, an embodiment of the present invention provides a multi-channel signal encoding and decoding system. The system includes:

an encoding end 1102, configured to: determine a sum of channel level differences (CLDs) of a current frame of a multi-channel signal in a certain frequency band area; determine an average value of sums of channel level differences (CLDs) of at least two frames before the current frame in the certain frequency band area; according to the sum of CLDs of the current frame, the average value of the sums of CLDs of at least two frames before the current frame, and a preset threshold, judge whether the CLDs of the current frame are in a transient state or a non-transient state, and obtain a judgment result; according to the judgment result, perform quantization processing on the channel level differences of the current frame of the multi-channel signal to obtain encoding data of channel level differences of the current frame; and send the judgment result to a decoding end; and a decoding end 1104, configured to receive the encoding data of the channel level differences of the current frame and the judgment result from the encoding end, and de-quantize the encoding data of the channel level differences of the current frame according to the judgment result.

If the judgment result information indicates that the CLDs of the current frame are in the transient state, the decoding end 1104 uses first quantization precision to de-quantize the encoding data of the channel level differences of the current frame of the multi-channel signal; and if the judgment result information indicates that the CLDs of the current frame are in the non-transient state, the decoding end 1104 uses second quantization precision to de-quantize the encoding data of the channel level differences of the current frame of the multi-channel signal; the first quantization precision is higher than the second quantization precision. For example, the first quantization precision is 5, and the second quantization precision is 1. The channel level differences of the current frame of the multi-channel signal that are quantized in this embodiment may be channel level differences in an entire frequency band or a certain frequency band area.

Other details about the encoding end and decoding end in this embodiment are similar to those in Embodiment 1 to Embodiment 8.

All the units in this embodiment may be integrated or separately deployed. The preceding unit may be combined into one unit, or further divided into a plurality of sub units. The encoding and decoding system in this embodiment may be applied to a mobile phone, an audio processing device, a computer, or a server.

The multi-channel signal in this embodiment include a multi-channel signal such as stereo, 5.1 audio channels, 7.1 audio channels, and 10.2 audio channels.

Through the embodiment of the present invention, by judging whether the CLDs of the current frame are in the transient or non-transient state, and performing quantization processing on the channel level differences of the current frame of the multi-channel signal according to the judgment result, flexibility in quantizing channel level differences of multi-channel signal may be improved; by using high quantization precision to quantize the CLDs of the current frame in the transient state, the re-establishment quality of the channel level differences of the current frame of the multi-channel signal may be maintained or improved; by using low quantization precision to quantize the channel level differences of the current frame in the non-transient state, a bit rate may be reduced, and the re-establishment quality of the channel level differences of the current frame may be maintained.

The units, algorithms, and steps in each example described in the public embodiments of the present invention may be implemented by electronic hardware, computer software, or combination of both. To clearly describe the changeability of the hardware and software, the composition and steps of each example are generally described according to functions in the preceding description. Whether these functions are executed through hardware or software depends on the specific applications and design constraints of the technical scheme. Those skilled in the art may use different methods to implement the described functions for each specific application. However, such implementation should not be considered as beyond the scope of the present invention.

The steps of the methods or algorithms described in the public embodiments of the present invention may be implemented by hardware, software modules executed by the processor, or a combination of both. The software module may be placed in a random access memory (RAM), memory, read only memory (ROM), electrically programmable ROM, electrically erasable and programmable ROM, register, hard disk, mobile disk, CD-ROM, or any other form of storage medium.

The above are merely specific embodiments of the present invention. However, the scope of the present invention is not limited thereto. Changes or replacements readily apparent to those skilled in the prior art within the technical scope of the present invention should fall within the scope of the present invention. Therefore, the protection scope of the present invention is subject to the appended claims.

What is claimed is:

1. A multi-channel signal encoding method, comprising:

determining, by an encoding end, a sum of channel level differences (CLDs) of a current frame of a multi-channel signal in a certain frequency band area, wherein the encoding end comprises at least a processor;

determining, by the encoding end, an average value of sums of channel level differences of at least two frames before the current frame in the certain frequency band area;

according to the sum of the channel level differences of the current frame of the multi-channel signal in the certain frequency band area, the average value of the sums of the channel level differences of the at least two frames before the current frame in the certain frequency band area, and a preset threshold, judging, by the encoding end, whether the channel level differences of the current frame are in a transient state or a non-transient state, and obtaining a judgment result; and according to the judgment result, performing, by the encoding end, quantization processing on the channel level differences of the current frame of the multi-channel signal.

2. The multi-channel signal encoding method according to claim 1, wherein the certain frequency band area is an entire frequency band or a preset partial frequency band area.

3. The multi-channel signal encoding method according to claim 1, wherein the determining the average value of the sums of the channel level differences of the at least two frames before the current frame in the certain frequency band area comprises:

according to the sum of the channel level differences of the current frame in the certain frequency band area, and a sum of channel level differences of N−1 frames before the current frame in the certain frequency band area, calculating, by the encoding end, an average value of sums of channel level differences of N frames that comprise the current frame and the N−1 frames before the current frame.

4. The multi-channel signal encoding method according to claim 1, wherein, according to the sum of the channel level differences of the current frame of the multi-channel signal in the certain frequency band area, the average value of the sums of the channel level differences of the at least two frames before the current frame in the certain frequency band area, and the preset threshold, judging whether the CLDs of the current frame are in the transient state or the non-transient state, and obtaining the judgment result comprise:

obtaining, by the encoding end, an absolute value of a difference between the sum of the channel level differences of the current frame in the certain frequency band area and the average value of the sums of the channel level differences of the at least two frames before the current frame;

comparing, by the encoding end, the absolute value of the difference with the preset threshold;

if the absolute value of the difference is greater than the threshold, determining, by the encoding end, that the channel level differences of the current frame are in the transient state; and if the absolute value of the difference is smaller than the threshold, determining, by the encoding end, that the channel level differences of the current frame are in the non-transient state.

5. The multi-channel signal encoding method according to claim 1, wherein according to the judgment result, performing quantization processing on the channel level differences of the multi-channel signal comprises:

if the channel level differences of the current frame are in the transient state, using, by the encoding end, first quantization precision to quantize the channel level differences of the current frame of the multi-channel signal;

if the channel level differences of the current frame are in the non-transient state, using, by the encoding end, second quantization precision to quantize the channel level differences of the current frame of the multi-channel signal; and wherein the first quantization precision is higher than the second quantization precision.

6. The multi-channel signal encoding method, comprising:

determining a sum of channel level differences (CLDs) of a current frame of a multi-channel signal in a certain frequency band area;

determining an average value of sums of channel level differences of at least two frames before the current frame in the certain frequency band area;

according to the sum of the channel level differences of the current frame of the multi-channel signal in the certain frequency band area, the average value of the sums of the channel level differences of the at least two frames before the current frame in the certain frequency band area, and a preset threshold, judging whether the channel level differences of the current frame are in a transient state or a non-transient state, and obtaining a judgment result;

according to the judgment result, performing quantization processing on the channel level differences of the current frame of the multi-channel signal; and sending the judgment result to a decoding end, so that the decoding end decodes encoding data of the channel level differences of the current frame according to the judgment result.

7. A multi-channel signal encoding method, comprising:

determining a sum of channel level differences (CLDs) of a current frame of a multi-channel signal in a certain frequency band area;

determining an average value of sums of channel level differences of at least two frames before the current frame in the certain frequency band area;

according to the sum of the channel level differences of the current frame of the multi-channel signal in the certain frequency band area, the average value of the sums of the channel level differences of the at least two frames before the current frame in the certain frequency band area, and a preset threshold, judging whether the channel level differences of the current frame are in a transient state or a non-transient state, and obtaining a judgment result;

according to the judgment result, performing quantization processing on the channel level differences of the current frame of the multi-channel signal, wherein according to the judgment result, performing quantization processing on the channel level differences of the multi-channel signal comprises:

if the channel level differences of the current frame are in the transient state, using first quantization precision to quantize the channel level differences of the current frame of the multi-channel signal;

if the channel level differences of the current frame are in the non-transient state, using second quantization precision to quantize the channel level differences of the current frame of the multi-channel signal;

wherein the first quantization precision is higher than the second quantization precision;

if the channel level differences of the current frame are in the transient state, sending first quantization precision to the decoding end, so that the decoding end uses the first quantization precision to de-quantize encoding data of the channel level differences of the current frame of the multi-channel signal; and if the channel level differences of the current frame are in the non-transient state, sending the second quantization precision to the decoding end, so that the decoding end uses the second quantization precision to de-quantize the encoding data of the channel level differences of the current frame of the multi-channel signal.

8. A multi-channel signal decoding method, comprising:

receiving encoding information from an encoding end, wherein the encoding information indicates whether channel level differences of a current frame of a multi-channel signal are in a transient state or a non-transient state;

if the encoding information indicates that the channel level differences of the current frame are in the transient state, using first quantization precision to de-quantize encoding data of the channel level differences of the current frame of the multi-channel signal;

if the encoding information indicates that the channel level differences of the current frame are in the non-transient state, using second quantization precision to de-quantize the encoding data of the channel level differences of the current frame of the multi-channel signal; and wherein the first quantization precision is higher than the second quantization precision.

9. The multi-channel signal decoding method according to claim 8, further comprising:

receiving the encoding data of the channel level differences of the current frame from the encoding end.

10. A multi-channel signal encoding apparatus, comprising:

a first determining unit, configured to determine a sum of channel level differences (CLDs) of a current frame of a multi-channel signal in a certain frequency band area;

a second determining unit, configured to determine an average value of sums of channel level differences (CLDs) of at least two frames before the current frame in the certain frequency band area;

a judging unit, configured to: according to the sum of the channel level differences (CLDs) of the current frame of the multi-channel signal in the certain frequency band area, the average value of the sums of the channel level differences (CLDs) of the at least two frames before the current frame in the certain frequency band area, and a preset threshold, judge whether the channel level differences of the current frame are in a transient state or a non-transient state, and obtain a judgment result; and a quantizing unit, configured to: according to the judgment result, perform quantization processing on the channel level differences of the current frame of the multi-channel signal, wherein at least one of the first determining unit, the second determining unit, the judging unit, and the quantizing unit is implemented by electronic hardware that comprises at least a processor.

11. The multi-channel signal encoding apparatus according to claim 10, wherein the judging unit comprises:

a calculating unit, configured to obtain an absolute value of a difference between the sum of channel level differences (CLDs) of the current frame in the certain frequency band area and the average value of the sums of channel level differences of the at least two frames before the current frame; and a comparing unit, configured to compare the absolute value of the difference obtained by the calculating unit with the preset threshold; if the absolute value of the difference is greater than the threshold, determine that the channel level differences (CLDs) of the current frame are in the transient state; and if the absolute value of the difference is smaller than the threshold, determine that the channel level differences (CLDs) of the current frame are in the non-transient state.

12. The multi-channel signal encoding apparatus according to claim 10, wherein the quantizing unit comprises:

a first quantizing unit, configured to use first quantization precision to quantize the channel level differences of the current frame of the multi-channel signal when the judging unit determines that the CLDs of the current frame are in the transient state;

a second quantizing unit, configured to use second quantization precision to quantize the channel level differences of the current frame of the multi-channel signal when the judging unit determines that the CLDs of the current frame are in the non-transient state; and wherein the first quantization precision is higher than the second quantization precision.

13. The multi-channel signal encoding apparatus according to claim 10, further comprising:

a judgment result sending unit, configured to send the judgment result obtained by the judging unit to a decoding end, so that the decoding end decodes encoding data of the channel level differences of the current frame according to the judgment result.

14. The multi-channel signal encoding apparatus according to claim 12, further comprising:

a quantization precision information sending unit, configured to: when the judging unit determines that the channel level differences (CLDs) of the current frame are in the transient state, send the first quantization precision to the decoding end, so that the decoding end de-quantizes encoding data of the channel level differences of the current frame of the multi-channel signal according to the first quantization precision; and when the judging unit determines that the channel level differences (CLDs) of the current frame are in the non-transient state, send the second quantization precision to the decoding end, so that the decoding end de-quantizes the encoding data of the channel level differences of the current frame of the multi-channel signal according to the second quantization precision.

15. A multi-channel signal decoding apparatus, comprising:

a receiving unit, configured to receive encoding information from an encoding end, wherein the encoding information indicates whether channel level differences (CLDs) of a current frame of a multi-channel signal are in a transient state or a non-transient state;

a reverse quantizing unit, configured to: if the encoding information indicates that the channel level differences (CLDs) of the current frame are in the transient state, use first quantization precision to de-quantize encoding data of the channel level differences of the current frame of the multi-channel signal; and if the encoding information indicates that the channel level differences (CLDs) of the current frame are in the non-transient state, use second quantization precision to de-quantize encoding data of the channel level differences of the current frame of the multi-channel signal, wherein the first quantization precision is higher than the second quantization precision, and wherein at least one of the first receiving unit and the reverse quantizing unit is implemented by electronic hardware that comprises at least a processor.

16. The multi-channel signal decoding apparatus according to claim 15, wherein the receiving unit is further configured to:

receive the encoding data of the channel level differences of the current frame from the encoding end.

17. A multi-channel signal encoding and decoding system, comprising:

an encoding end, configured to: determine a sum of channel level differences (CLDs) of a current frame of a multi-channel signal in a certain frequency band area; determine an average value of sums of channel level differences (CLDs) of at least two frames before the current frame in the certain frequency band area; according to the sum of channel level differences of the current frame of the multi-channel signal in the certain frequency band area, the average value of the sums of channel level differences of at least two previous frames of the current frame in the certain frequency band area, and a preset threshold, judge whether the CLDs of the current frame are in a transient state or a non-transient state, and obtain a judgment result; according to the judgment result, perform quantization processing on the channel level differences of the current frame of the multi-channel signal to obtain encoding data of channel level differences of the current frame; and send the encoding data of channel level differences of the current frame and the judgment result to a decoding end; and a decoding end, configured to receive the encoding data of the channel level differences of the current frame and the judgment result sent from the encoding end, and de-quantize the encoding data of channel level differences of the current frame according to the judgment result, wherein at least one of the encoding end and the decoding end is implemented by electronic hardware that comprises at least a processor.

18. The multi-channel signal encoding and decoding system according to claim 17, wherein the decoding end is configured to: when the judgment result indicates that the CLDs of the current frame are in the transient state, use first quantization precision to de-quantize encoding data of the channel level differences of the current frame of the multi-channel signal; and when the judgment result indicates that the CLDs of the current frame are in the non-transient state, use second quantization precision to de-quantize the encoding data of the channel level differences of the current frame of the multi-channel signal; and wherein the first quantization precision is higher than the second quantization precision.

* * * * *

UNITED STATES PATENT AND TRADEMARK OFFICE

CERTIFICATE OF CORRECTION

PATENT NO. : 8,626,518 B2
APPLICATION NO. : 13/530819
DATED : January 7, 2014
INVENTOR(S) : Yue Lang et al.

It is certified that error appears in the above-identified patent and that said Letters Patent is hereby corrected as shown below:

On the Title Page, item (75) Inventors should read:

"Yue Lang, Munchen (DE); Wenhai Wu, Shenzhen (CN); Lei Miao, Shenzhen (CN); Chen Hu, Shenzhen (CN)"

In the Claims

Column 17/Line 11 should read: "signal,"

Column 17/Line 14 should read: "6. A multi-channel signal encoding method, comprising:"

Column 17/Line 67 should read: "current frame of the multi-channel signal,"

Column 18/Line 31 should read: "current frame of the multi-channel signal,"

Column 19/Line 25 should read: "frame are in the non-transient state,"

Column 20/Line 58 should read: "channel signal,"

Signed and Sealed this
First Day of April, 2014

Michelle K. Lee

Michelle K. Lee
*Deputy Director of the United States Patent and Trademark Office*